US009352598B2

(12) United States Patent
Nakata et al.

(10) Patent No.: US 9,352,598 B2
(45) Date of Patent: May 31, 2016

(54) PRINTER, METHOD OF PRINTING, AND NON-TRANSITORY RECORDING MEDIUM

(71) Applicants: Tetsuyoshi Nakata, Kanagawa (JP); Yasunari Harada, Kanagawa (JP); Jun Watanabe, Tokyo (JP); Tomoko Fukasawa, Kanagawa (JP); Ryuuichi Satoh, Kanagawa (JP); Hiroki Tanaka, Kanagawa (JP); Toshiaki Hosokawa, Kanagawa (JP)

(72) Inventors: Tetsuyoshi Nakata, Kanagawa (JP); Yasunari Harada, Kanagawa (JP); Jun Watanabe, Tokyo (JP); Tomoko Fukasawa, Kanagawa (JP); Ryuuichi Satoh, Kanagawa (JP); Hiroki Tanaka, Kanagawa (JP); Toshiaki Hosokawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/847,636

(22) Filed: Sep. 8, 2015

(65) Prior Publication Data

US 2016/0107467 A1 Apr. 21, 2016

(30) Foreign Application Priority Data

Oct. 20, 2014 (JP) ..... 2014-213412

(51) Int. Cl.
*B41J 29/393* (2006.01)
*B41J 29/38* (2006.01)

(52) U.S. Cl.
CPC ..... *B41J 29/38* (2013.01)

(58) Field of Classification Search
CPC ..... B41J 29/393; B41J 2/125; B41J 2/2146; B41J 2/14153; B41J 19/202; B41J 19/205; B41J 2/04506; B41J 2/04508; B41J 2/04541; B41J 2/07
See application file for complete search history.

(56) References Cited

U.S. PATENT DOCUMENTS 7,857,439 B2 * 12/2010 Jones ..... B41J 2/17593 347/88
8,727,473 B2 * 5/2014 Calamita ..... B41J 25/003 347/14
2008/0144053 A1 6/2008 Gudan et al.

FOREIGN PATENT DOCUMENTS

JP 2008-094101 4/2008
JP 2010-520087 6/2010
JP 2010-535118 11/2010
WO WO2008/109550 A1 9/2008
WO WO2009/021140 A1 2/2009

* cited by examiner

*Primary Examiner* — Lamson Nguyen
(74) *Attorney, Agent, or Firm* — Cooper & Dunham LLP

(57) ABSTRACT

A printer including an optical moving amount calculator, an angle calculator, and a moving amount corrector is provided. The optical moving amount calculator calculates a moving amount of the printer or an object to be irradiated after a movement thereof, based on a difference in image data generated before and after the movement. The image data is generated by emitting light to the print medium or the object and receiving light reflected therefrom. The angle calculator calculates a deviation angle of an installation angle of the optical moving amount calculator installed in the printer, based on a calibration moving amount of the printer or the object after a calibration movement thereof that is a parallel translation. The moving amount corrector corrects the moving amount of the printer after the movement thereof, based on the calculated deviation angle of the optical moving amount calculator.

7 Claims, 18 Drawing Sheets

PRINTER, METHOD OF PRINTING, AND NON-TRANSITORY RECORDING MEDIUM

CROSS-REFERENCE TO RELATED APPLICATIONS

This patent application is based on and claims priority pursuant to 35 U.S.C. §119(a) to Japanese Patent Application No. 2014-213412, filed on Oct. 20, 2014, in the Japan Patent Office, the entire disclosure of which is hereby incorporated by reference herein.

BACKGROUND

1. Technical Field

The present disclosure relates to a printer performing printing while being moved on a print medium, a method of printing performed by a printer being moved on a print medium, and a non-transitory recording medium storing a plurality of instructions which, when executed by one or more processors, cause the processors to perform the method.

2. Description of the Related Art

In accordance with the rapid spread of smart devices such as compact laptop and smart phone, there is a demand for portable compact printers. To respond to this demand, hand-held printers have been proposed. Hand-held printers are capable of applying liquid droplets of ink, etc., to a print medium such as paper sheet while being freely moved on the print medium.

SUMMARY

In accordance with some embodiments of the present invention, a printer performing printing while being moved on a print medium is provided. The printer includes an optical moving amount calculator, an angle calculator, and a moving amount corrector. The optical moving amount calculator calculates a moving amount of the printer or an object to be irradiated after a movement thereof, based on a difference in image data generated before and after the movement. The image data is generated by emitting light to the print medium or the object and receiving light reflected therefrom. The angle calculator calculates a deviation angle of an installation angle of the optical moving amount calculator installed in the printer, based on a calibration moving amount of the printer or the object after a calibration movement thereof that is a parallel translation. The moving amount corrector corrects the moving amount of the printer after the movement thereof, based on the calculated deviation angle of the optical moving amount calculator.

In accordance with some embodiments of the present invention, the method of printing performed by a printer being moved on a print medium is provided. The method includes the step of: emitting light to the print medium or an object to be irradiated; receiving light reflected from the print medium or the object to generate image data; calculating a moving amount of the printer after a movement thereof, based on a difference in the image data generated before and after the movement; calculating a deviation angle of an installation angle of the optical moving amount calculator installed in the printer, based on a calibration moving amount of the printer or the object after a calibration movement thereof that is a parallel translation; and correcting the moving amount of the printer after the movement thereof, based on the calculated deviation angle of the optical moving amount calculator.

In accordance with some embodiments of the present invention, a non-transitory recording medium storing a plurality of instructions which, when executed by one or more processors, cause the processors to perform the above method is provided.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
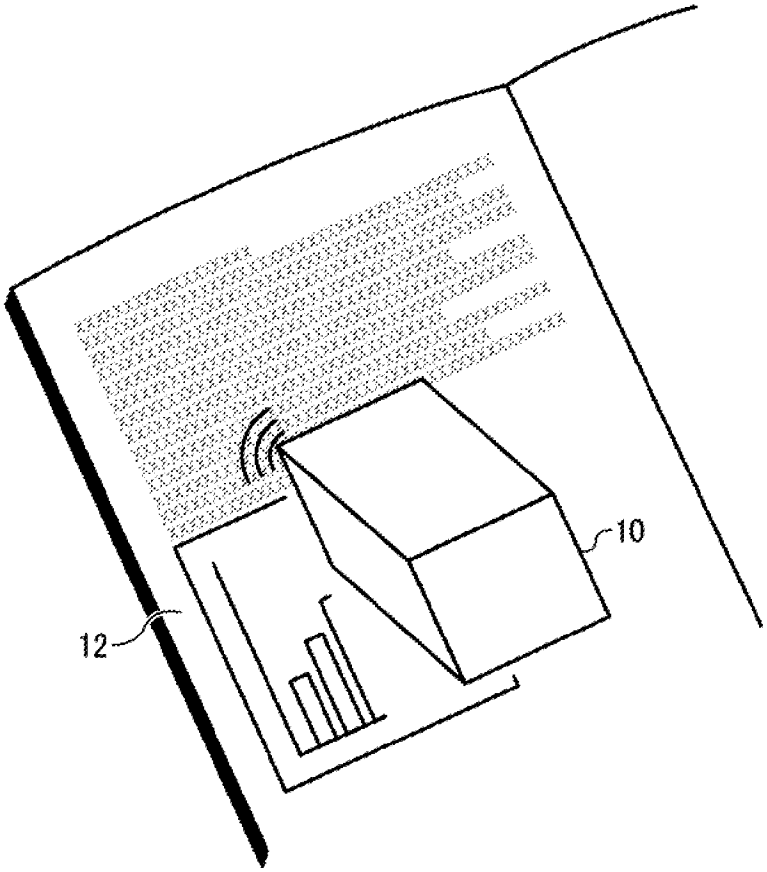
FIG. 1 is a schematic view illustrating a printing system in accordance with an embodiment of the present invention.
Figure 1:
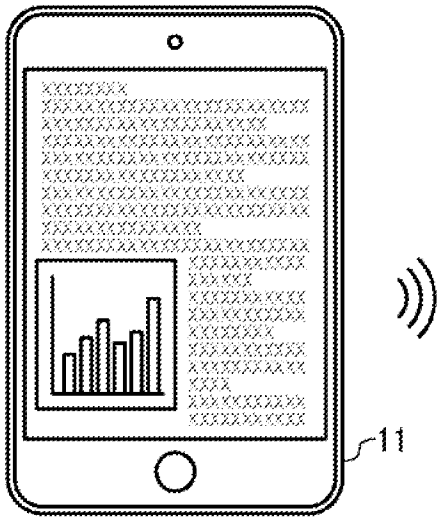

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

In accordance with some embodiments of the present invention, a printer is provided which can accurately calculate the position thereof even when a calculator that optically calculates the moving amount thereof is installed in the printer at an improper angle.

FIG. 1 is a schematic view illustrating a printing system in accordance with an embodiment of the present invention. The printing system illustrated in FIG. 1 includes a hand-held printer 10, an image provider 11, and a print medium 12.

The hand-held printer 10 is capable of printing image on the print medium 12 while being freely moved on the print medium 12 by user. The hand-held printer 10 preferably has a size and weight that can be carried by user. The hand-held printer 10 is capable of forming image on various print media such as paper (e.g., notebook), wall surface, board, and clothes.

The hand-held printer 10 is an inkjet-type printer that discharges liquid droplets of a pigment ink, a dye ink, or the like, from nozzles built in the hand-held printer 10. However, the hand-held printer 10 is not limited in printing type. For example, the hand-held printer 10 may be a dot-impact-type printer that makes prints by striking a tiny pin against an ink ribbon. The hand-held printer 10 may employ either a monochrome printing type or a color printing type.

The hand-held printer 10 receives image data of a print target from the image provider 11 and discharges liquid droplets on the print medium 12 based on the image data to form an image. The image data may be text data consisting of texts, document data containing graphics, illustration, pictures, etc., table data, or the like. The hand-held printer 10 also receives various print setting information, such as print color type (monochrome or color), resolution, and the like, along with the image data, and discharges liquid droplets based on the print setting information.

The hand-held printer 10 receives image data from the image provider 11 through wireless communication such as infrared communication, Bluetooth (registered trademark), and Wi-Fi (registered trademark). The hand-held printer 10 may receive image data from the image provider 11 either directly or indirectly through access points, etc. The hand-held printer 10 may receive image data through not only wireless communication but also wire communication.

The image provider 11 provides image data of a print target to the hand-held printer 10. Electronic devices such as smart phone, tablet terminal, and laptop may be employed as the image provider 11.

In the present embodiment, the image provider 11 transmits image data of a print target to the hand-held printer 10 through wireless communication. In other embodiments, the image provider 11 may transmit image data provided by another image provider, such as a server, to the hand-held printer 10.

The image provider 11 includes: a central processing unit (CPU) that executes programs of applications for displaying or editing image of a print target, operation system (OS), etc.; a read only memory (ROM) that stores the programs of applications, OS, etc.; a random access memory (RAM) that provides a space for executing the programs; a display device for displaying image data of the print target; and an input device to which user inputs print instruction for the image data. The display device and the input device may be either independent from each other or integrally combined into a touch panel.

Figure 2:
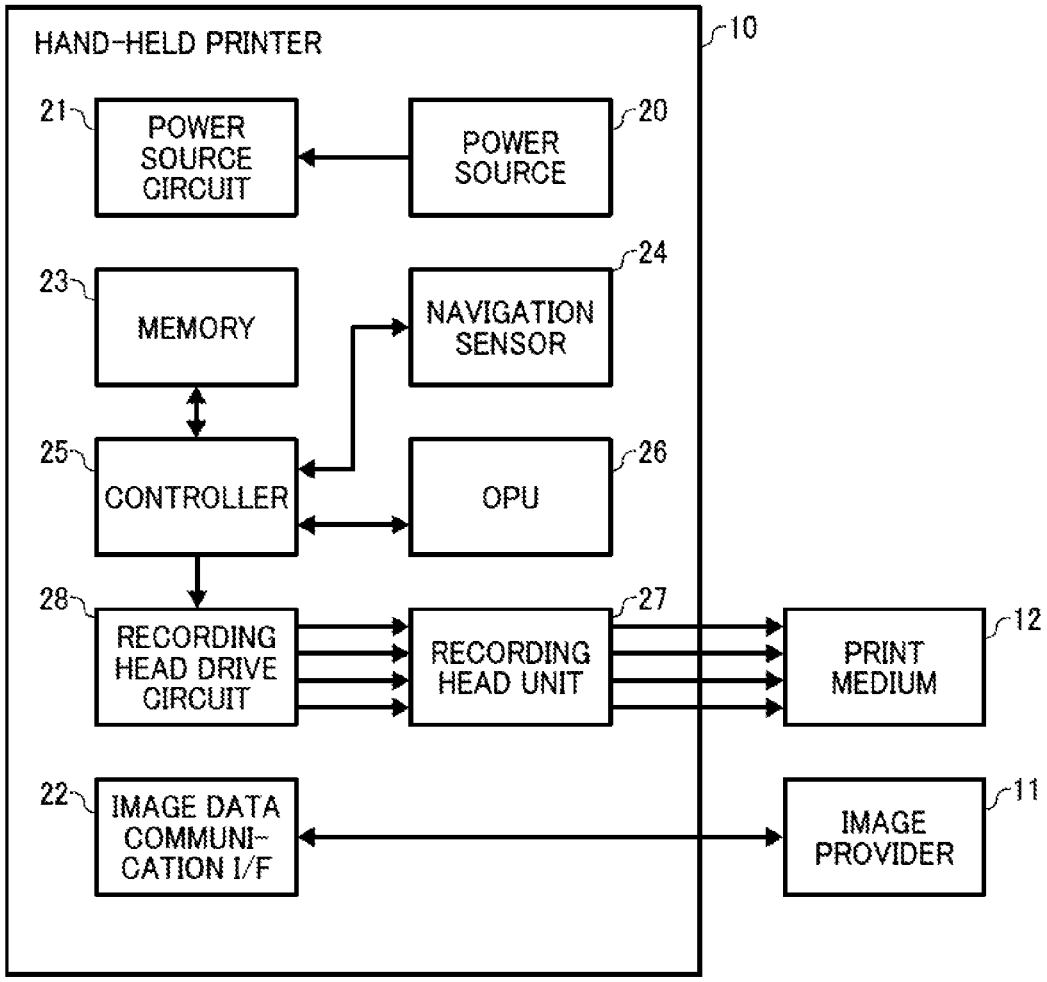
FIG. 2 is a block diagram of a hardware configuration of a hand-held printer in the printing system.

FIG. 2 is a block diagram of a hardware configuration of the hand-held printer 10. The hardware configuration of the hand-held printer 10 is described below with reference to FIG. 2.

The hand-held printer 10 includes a power source 20, a power source circuit 21, an image data communication I/F 22, a memory 23, a navigation sensor 24, a controller 25, an operation unit (OPU) 26, a recording head unit 27, and a recording head drive circuit 28.

The power source 20 (e.g., an electric battery) supplies electric power used by the hand-held printer 10. The power source circuit 21 controls electric power supply to each unit in the hand-held printer 10.

The image data communication I/F 22 receives data transmitted by the image provider 11. The image data communication I/F 22 receives data transmitted through wireless communication such as wireless local area network (LAN), Bluetooth (registered trademark), and near field communication (NFC).

The memory 23 is composed of a read only memory (ROM) and a dynamic random access memory (DRAM). The ROM stores programs for executing hardware control of the hand-held printer 10, drive waveform data for driving the recording head, and initial setting information data, and the like. The DRAM provides a space for executing programs and temporarily stores various data such as image data and drive waveform data.

The navigation sensor 24 optically calculates a moving amount of the navigation sensor 24. The navigation sensor 24 emits light to an object to be irradiated (e.g., a print medium) and photographs the reflected light to generate image data, and calculates a moving amount of the navigation sensor 24 based on a difference in the image data generated before and after a movement of the hand-held printer 10.

The controller 25 controls the entire hand-held printer 10. The hardware configuration of the hand-held printer 10 is described in detail later with reference to FIG. 3.

The OPU 26 includes an input device (e.g., switch, operation key) that accepts a print operation instruction from user and a notification device that notifies the user of the condition of the hand-held printer 10. As the notification device, a light emitting diode (LED) or a liquid crystal display (LCD) may be employed.

The recording head unit 27 includes a recording head having multiple nozzles that discharge liquid droplets of an ink or the like. The recording head drive circuit 28 controls the recording head included in the recording head unit 27.

Figure 3:
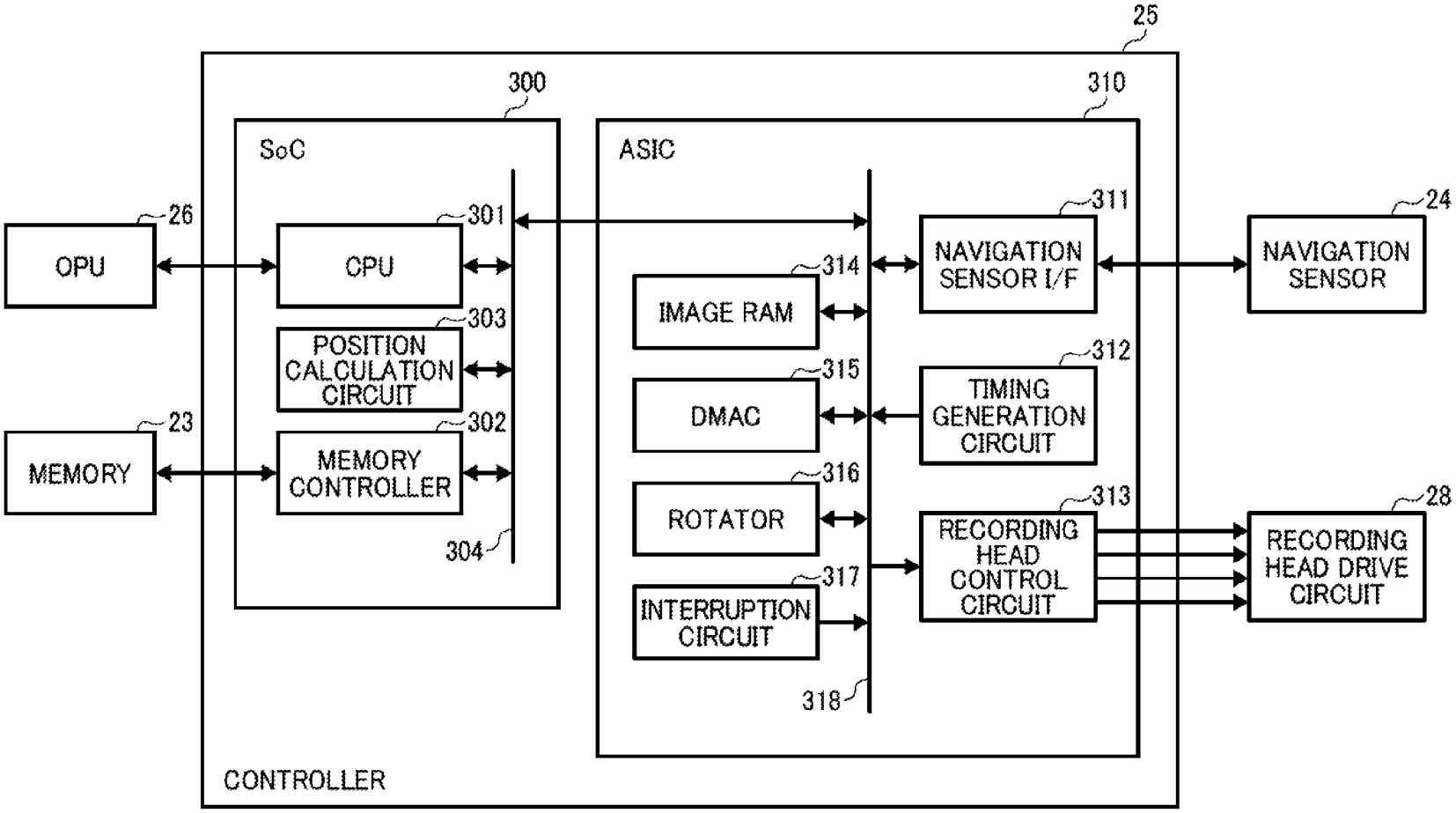
FIG. 3 is a block diagram of a hardware configuration of a controller in the hand-held printer.

FIG. 3 is a block diagram of a hardware configuration of the controller 25. The hardware configuration of the controller 25 is described below with reference to FIG. 3.

The controller 25 includes a system on chip (SoC) 300 and an application specific integrated circuit (ASIC) 310. The SoC 300 includes a central processing unit (CPU) 301, a memory controller 302, and a position calculation circuit 303. These devices are connected to a bus 304, and perform data communication through the bus 304.

The CPU 301 controls the entire hand-held printer 10. The memory controller 302 controls the memory 23.

The position calculation circuit 303 calculates a position coordinate of the navigation sensor 24 using the moving amount of the navigation sensor 24 provided by the navigation sensor 24.

The ASIC 310 includes a navigation sensor I/F 311, a timing generation circuit 312, a recording head control circuit 313, an image RAM 314, and a direct memory access controller (DMAC) 315, a rotator 316, and an interrupt circuit 317. These devices are connected to a bus 318, and perform data communication through the bus 318. The bus 318 is connected to the bus 304. The SoC 300 and the ASIC 310 perform data communication through the buses 318 and 304.

The timing generation circuit 312 generates a timing when the navigation sensor I/F 311 reads output information from the navigation sensor 24 and another timing when the recording head discharges liquid droplets, and notifies the navigation sensor I/F 311 and the recording head control circuit 313 of these timings.

The navigation sensor I/F 311 performs data communication with the navigation sensor 24. The navigation sensor I/F 311 receives the moving amount of the navigation sensor 24 that is the output information from the navigation sensor 24 at a timing specified by the timing generation circuit 312, and stores it in an internal register that is an internal memory of the navigation sensor I/F 311.

The DMAC 315 reads out image data to be formed by discharging liquid droplets from the nozzles from the memory 23 through the memory controller 302 based on the position information of the nozzles calculated by the position calculation circuit 303, and stores it in the image RAM 314.

The image RAM 314 temporarily stores the image data read out by the DMAC 315.

The rotator 316 rotates image data of a print target in accordance with a rotation angle of the hand-held printer 10. The rotator 316 acquires image data from the image RAM 314 and rotates the image data in accordance with the rotation angle of the hand-held printer 10. When the image data satisfies a specific condition needed for discharge (hereinafter "discharge condition"), the rotator 316 transmits the image data to the recording head control circuit 313.

The recording head control circuit 313 controls the recording head drive circuit 28 to control discharge operation of the recording head. The recording head control circuit 313 transmits a control signal for controlling discharge operation of the recording head and image data of a print target to the recording head drive circuit 28 at a timing specified by the timing generation circuit 312.

The interrupt circuit 317 transmits an interrupt signal to the SoC 300. Upon termination of a communication between the navigation sensor I/F 311 and the navigation sensor 24, the interrupt circuit 317 transmits an interrupt signal which notifies the SoC 300 of the communication termination to the SoC 300. In addition, the interrupt circuit 317 transmits an interrupt signal which notifies the SoC 300 of status information such as error information to the SoC 300.

In the present embodiment, the ASIC 310 controls the navigation sensor 24 and the recording head drive circuit 28. In other embodiments, a field programmable gate array (FPGA), which allows user to set its configuration after production, may be used in place of the ASIC 310.

Figure 4:
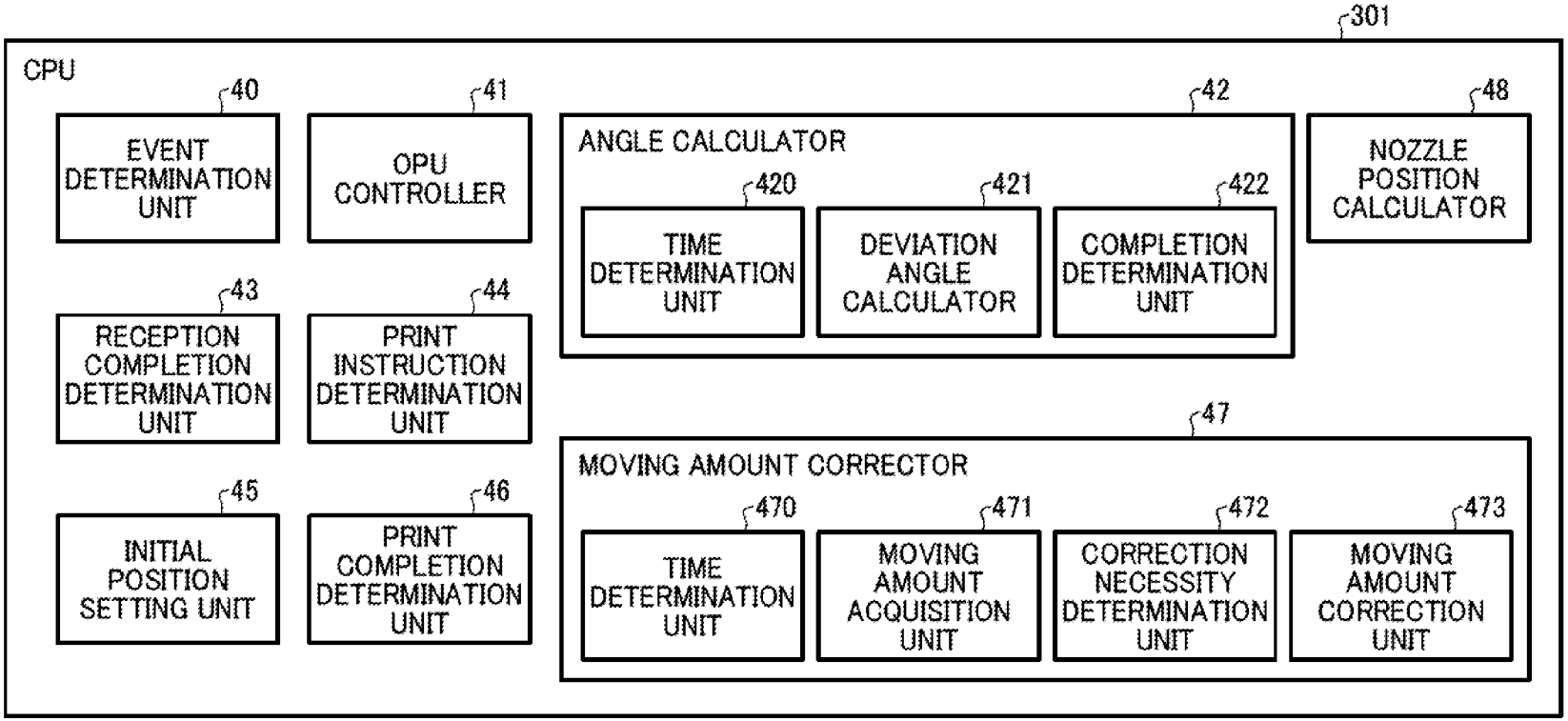
FIG. 4 is a block diagram of a functional configuration of a CPU in the controller.

FIG. 4 is a block diagram of a functional configuration of the CPU 301. One example of the functional configuration implemented to the CPU 301 is described below with reference to FIG. 4.

The CPU 301 includes an event determination unit 40, an OPU controller 41, an angle calculator 42, a reception completion determination unit 43, a print instruction determination unit 44, an initial position setting unit 45, a print completion determination unit 46, a moving amount corrector 47, and a nozzle position calculator 48.

The event determination unit 40 determines the type of an event issued by an operation by user. The OPU controller 41 controls the OPU 26.

Figure 11:
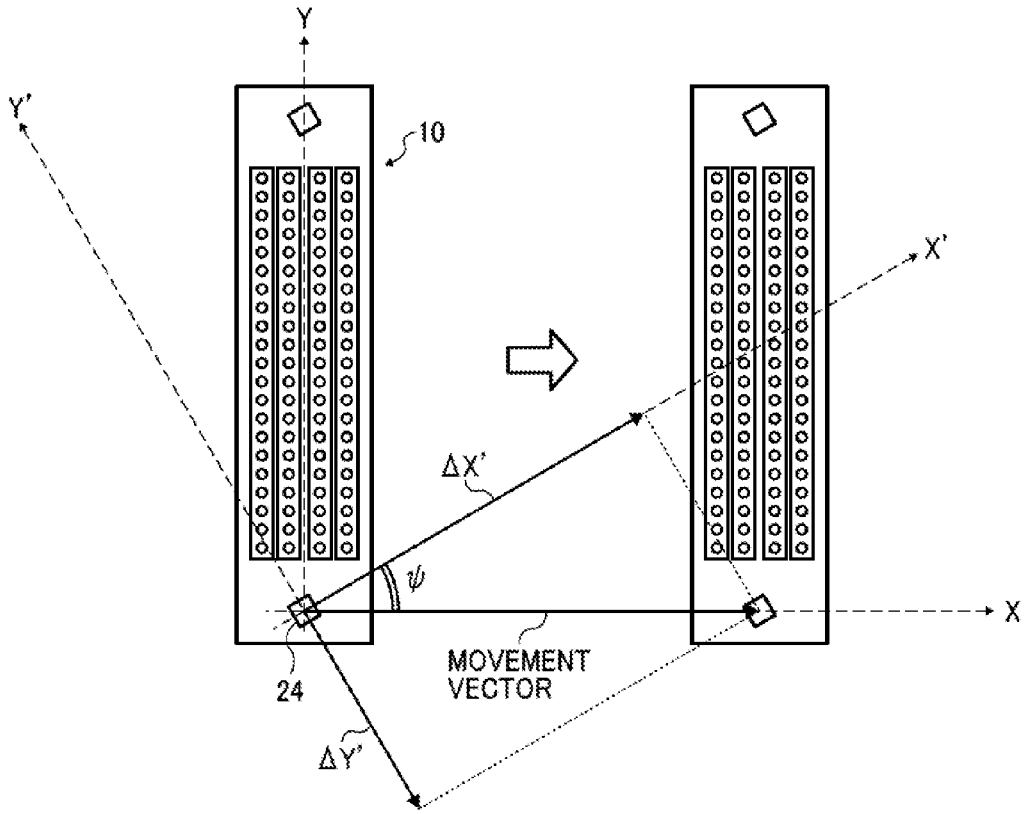
FIG. 11 is a schematic view of a recording head to which navigation sensors are installed at an abnormal installation angle.

The angle calculator 42 calculates a deviation angle of an installation angle of the navigation sensor 24. The deviation angle is defined as an angle formed between an X axis of an X-Y plane and an X' axis of an X'-Y' plane as illustrated in FIG. 11. The X-Y plane is defined by X and Y axes respectively coincident with lateral and longitudinal directions of the recording head of the hand-held printer 10. The X'-Y' plane is defined by X' and Y' axes respectively coincident with lateral and longitudinal directions of the navigation sensor 24 actually installed in the hand-held printer 10. When the deviation angle is zero, in other words, the navigation sensor 24 is properly installed at a right angle, the X-Y plane and the X'-Y' plane coincide with each other.

The angle calculator 42 includes a time determination unit 420, a deviation angle calculator 421, and a completion determination unit 422. The time determination unit 420 determines whether a preset time has lapsed or not using the timing generation circuit 312. The deviation angle calculator 421 calculates the deviation angle of the navigation sensor 24 using a moving amount obtained from the navigation sensor 24.

The completion determination unit 422 determines whether a test mode has been completed or not. The completion determination unit 422 can determine that the test mode has been completed upon reception of an event issued by depression of a test mode switch by user. Alternatively, the completion determination unit 422 may determine that the test mode has been completed as the total moving amount of the hand-held printer 10 exceeds a predetermined value. Alternatively, the completion determination unit 422 may determine that the test mode has been completed by detecting the hand-held printer 10 being lifted up.

The reception completion determination unit 43 determines whether reception of image data from the image provider 11 has been completed or not. The print instruction determination unit 44 determines whether a print instruction has been accepted or not. The initial position setting unit 45 sets an initial position of the hand-held printer 10.

The print completion determination unit 46 determines whether a printing has been completed or not. The print completion determination unit 46 determines that the printing has been completed upon completion of printing of the entire image data received from the image provider 11 or upon reception of an event issued by depression of a print completion instruction switch by user.

The moving amount corrector 47 includes a time determination unit 470, a moving amount acquisition unit 471, a correction necessity determination unit 472, and a moving amount correction unit 473. The time determination unit 470 determines whether a preset time has lapsed or not using the timing generation circuit 312. The moving amount acquisition unit 471 acquires a moving amount from the navigation sensor 24.

The correction necessity determination unit 472 determines whether the moving amount acquired from the navigation sensor 24 needs correction or not using the deviation angle of the navigation sensor 24. The correction necessity determination unit 472 determines that correction is unnecessary when the deviation angle is zero and that correction is necessary when the deviation angle is other than zero.

The moving amount correction unit 473 corrects the moving amount of the navigation sensor 24 acquired from the navigation sensor 24 using the deviation angle of the navigation sensor 24.

The nozzle position calculator 48 calculates present position coordinates of all the nozzles included in the recording head based on the position coordinate of the navigation sensor 24. The nozzle position calculator 48 calculates position coordinates of all the nozzles based on the position coordinate of the navigation sensor 24 calculated by the position calculation circuit 303.

Figure 5:
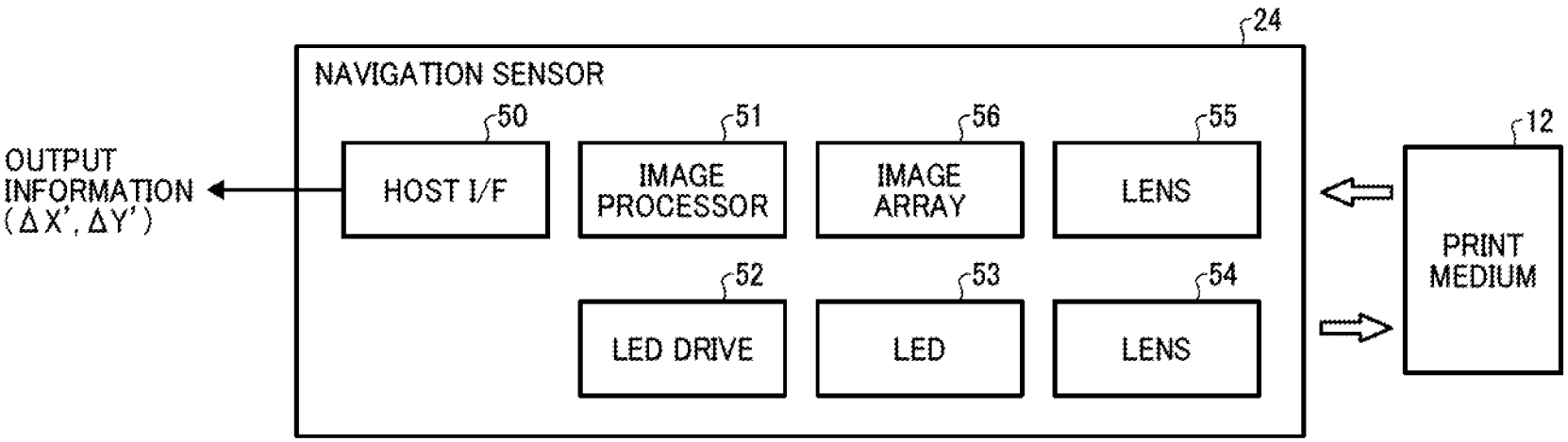
FIG. 5 is a block diagram of a hardware configuration of a navigation sensor in the hand-held printer.

FIG. 5 is a block diagram of a hardware configuration of the navigation sensor 24. The hardware configuration of the navigation sensor 24 is described below with reference to FIG. 5.

The navigation sensor 24 includes a host I/F 50, an image processor 51, an LED drive 52, a light emitting diode (LED) 53, lenses 54 and 55, and an image array 56.

The LED drive 52 controls the LED 53 to make it emit light. The LED 53 is a semiconductor element that emits light under control by the LED drive 52. The lens 54 collects light from the LED 53 and emits it to the print medium 12. The lens 55 collects light reflected from the surface of the print medium 12 and emits it to the image array 56.

The image array 56 receives light emitted from the LED 53 and then reflected from the print medium 12 to generate image data. The image array 56 outputs the generated image data to the image processor 51.

The image processor 51 processes the image data generated by the image array 56. The image processor 51 calculates a moving amount of the navigation sensor 24 from the image data. In particular, the image processor 51 calculates moving amounts $\Delta X'$ and $\Delta Y'$ in the X'-axis and Y'-axis directions on the X'-Y' plane, respectively, as moving amounts of the navigation sensor 24, and transmits them to the controller 25 through the host I/F 50.

In the case where the print medium 12 has a rough surface, an LED is preferably employed as the light source. This is because LED light can form shades corresponding to the surface roughness of the print medium 12, and the shades can behave as characterizing portions in accurately calculating the moving distance of the navigation sensor 24.

On the other hand, in the case where the print medium 12 has a smooth surface or is transparent, a laser diode (LD) that emits laser light is preferably employed as the light source. This is because LD can form striped patterns or the like on the print medium 12, and the patterns can behave as characterizing portions.

Figure 6:
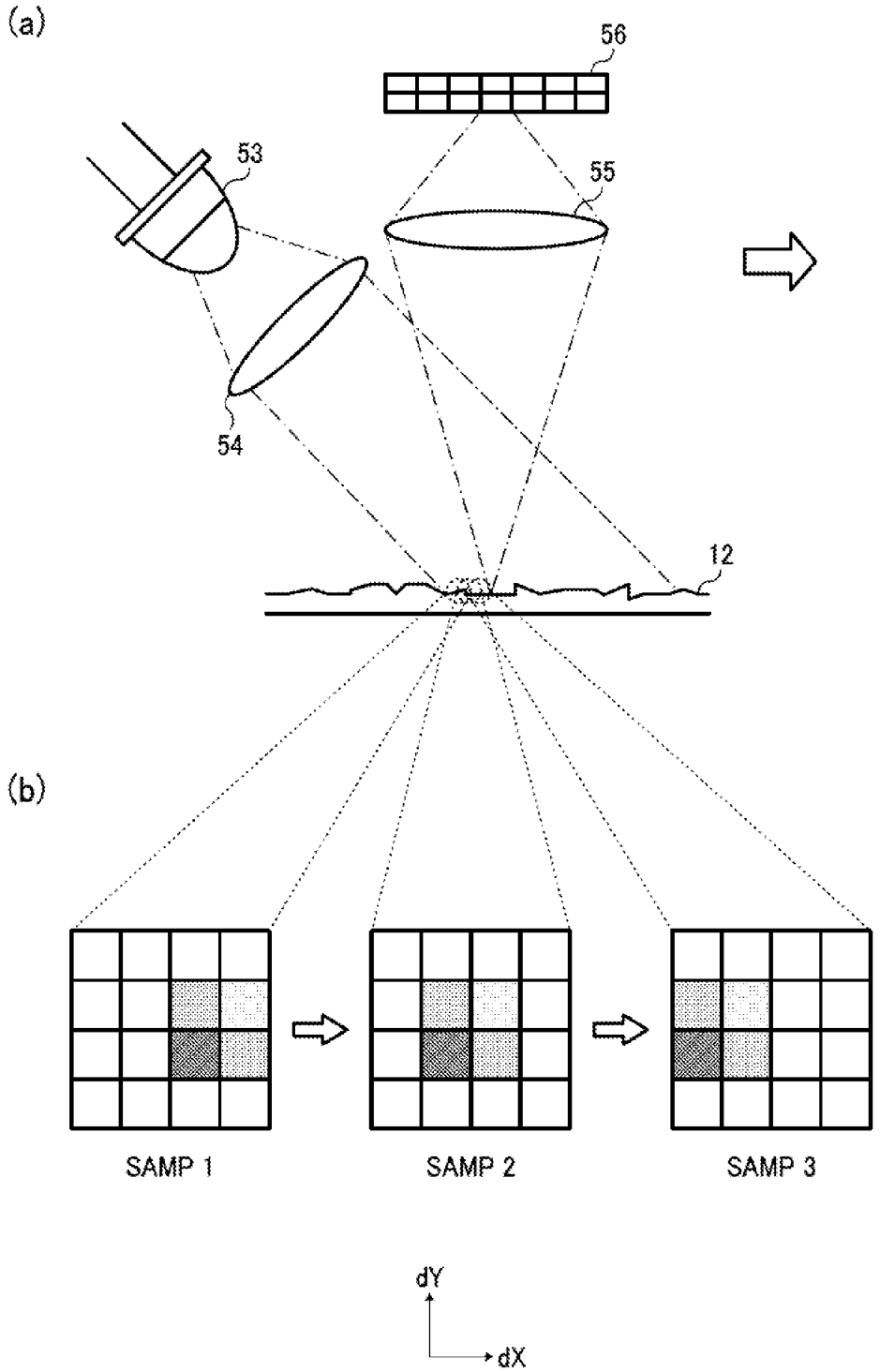
FIG. 6 is an illustration showing a method of calculating the moving amount of the navigation sensor.

FIG. 6 is an illustration showing a method of calculating the moving amount of the navigation sensor 24. The method of calculating the moving amount of the navigation sensor 24 is described below with reference to FIG. 6.

As illustrated in part (a) of FIG. 6, the navigation sensor 24 emits light obliquely from the LED 53 to the surface of the print medium 12 through the lens 54. Since the surface of the print medium 12 has micro irregularities in various shapes as shown in part (a) of FIG. 6, the light emitted from the LED 53 forms shades in various shapes thereon.

The image array 56 receives light reflected from the print medium 12 through the lens 55 at every predetermined timings to generate image data. The image processor 51 calculates the moving amount of the navigation sensor 24 by dividing the image data into multiple rectangular regions at a specified resolution unit, comparing image data obtained at the previous timing and that obtained at the present timing, and extracting these image data.

As an example, a case where image data illustrated in part (b) of FIG. 6 are obtained at respective timings Samp 1, Samp 2, and Samp 3 is considered below. With respect to image data shown in part (b) of FIG. 6, gray shaded portions, i.e., characterizing portions in the image data, shift from right to left by one resolution unit.

When setting Samp 1 as a reference timing, at Samp 2, the characterizing portions have shifted in the X-axis direction by one resolution unit. Therefore, the moving amount ($\Delta X'$,$\Delta Y'$) becomes (1,0). When setting Samp 2 as a reference timing, at Samp 3, the characterizing portions have shifted in the X-axis direction by one resolution unit. Therefore, the moving amount ($\Delta X'$,$\Delta Y'$) becomes (1,0), either. The unit of the moving amount depends on the device in use. The device preferably has a resolution of about 1,200 dpi.

Figure 7:
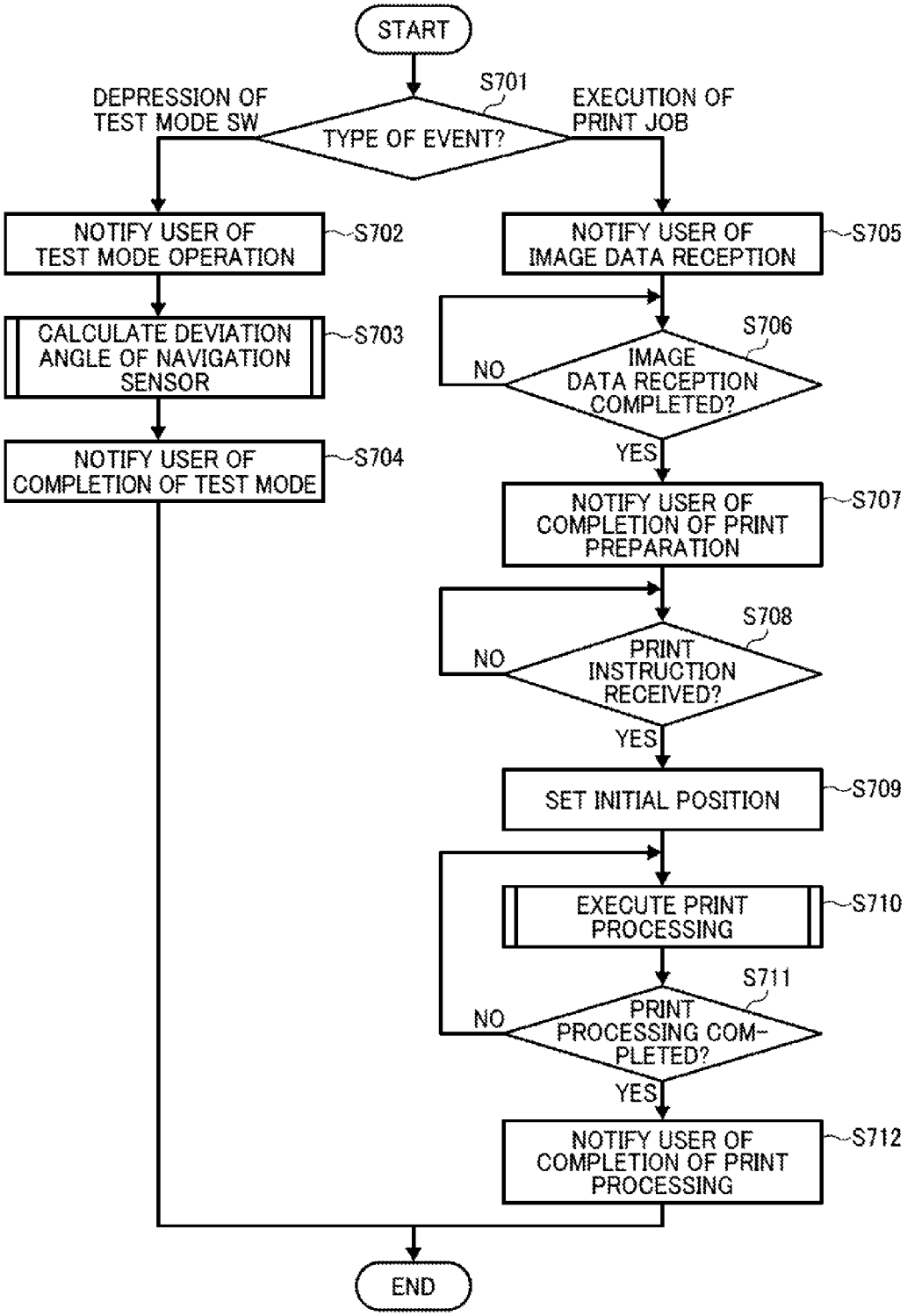
FIG. 7 is a flowchart illustrating a processing executed by the hand-held printer upon reception of an event in accordance with an embodiment of the present invention.

FIG. 7 is a flowchart illustrating a processing executed by the hand-held printer 10 upon reception of an event in accordance with an embodiment of the present invention. The processing executed by the hand-held printer 10 upon reception of an event corresponding to a user's operation is described below with reference to FIG. 7.

As the processing shown in FIG. 7 starts, in step S701, the event determination unit 40 of the CPU 301 determines the type of an event issued by an operation by user. When the type of the event is an event indicating depression of a test mode switch, the processing proceeds to step S702.

In step S702, the OPU controller 41 controls the OPU 26 to notify user that the hand-held printer 10 is in test mode operation. In the present embodiment, the OPU controller 41 turns on an LED which indicates that the hand-held printer 10 is in test mode operation. In other embodiments, the OPU controller 41 may display on the liquid crystal display of the hand-held printer 10 that the hand-held printer 10 is in test mode operation.

In step S703, the angle calculator 42 calculates a deviation angle of the navigation sensor 24. The process in step S703 is described in detail later with reference to FIG. 8.

In step S704, the OPU controller 41 controls the OPU 26 to notify user of completion of the test mode, and then the processing is completed. In the present embodiment, the OPU controller 41 turns off the LED which indicates that the hand-held printer 10 is in test mode operation. In other embodiments, completion of the test mode may be displayed on the liquid crystal display of the hand-held printer 10.

When the type of the event determined in step S701 is an event indicating execution of a print job, the processing proceeds to step S705. In step S705, the OPU controller 41 controls the OPU 26 to notify user that the hand-held printer 10 is receiving image data of a print target from the image provider 11. In the present embodiment, the OPU controller 41 causes a status LED to blink. In other embodiments, reception of image data may be displayed on the liquid crystal display of the hand-held printer 10.

In step S706, the reception completion determination unit 43 determines whether reception of image data has been completed or not. In step S707, the OPU controller 41 controls the OPU 26 to notify user that print preparation has been completed. In the present embodiment, the OPU controller 41 turns on the status LED and another LED which indicates that the print preparation has been completed. In other embodiments, completion of the print preparation may be displayed on the liquid crystal display of the hand-held printer 10.

In step S708, the print instruction determination unit 44 determines whether a print instruction has been accepted or not. More specifically, the print instruction determination unit 44 determines that a print instruction has been accepted upon reception of an event issued by depression of a print start instruction switch by user. When no print instruction has been accepted (NO), the process of step S708 is repeated. When a print instruction has been accepted (YES), the processing proceeds to step S709.

In step S709, the initial position setting unit 45 sets the present position of the hand-held printer 10 as its initial position. In step S710, a print processing is executed. Details of the print processing are described later with reference to FIG. 9. In step S711, the print completion determination unit 46 determines whether the print processing has been completed or not. When the print processing has not been completed (NO), the processing returns to step S710. When the print processing has been completed (YES), the processing proceeds to step S712.

In step S712, the OPU controller 41 controls the OPU 26 to notify user of completion of the print processing, and then the processing is completed. In the present embodiment, the OPU controller 41 turns off the LED which indicates that the print preparation has been completed. In other embodiments, completion of the print processing may be displayed on the liquid crystal display of the hand-held printer 10.

Figure 8:
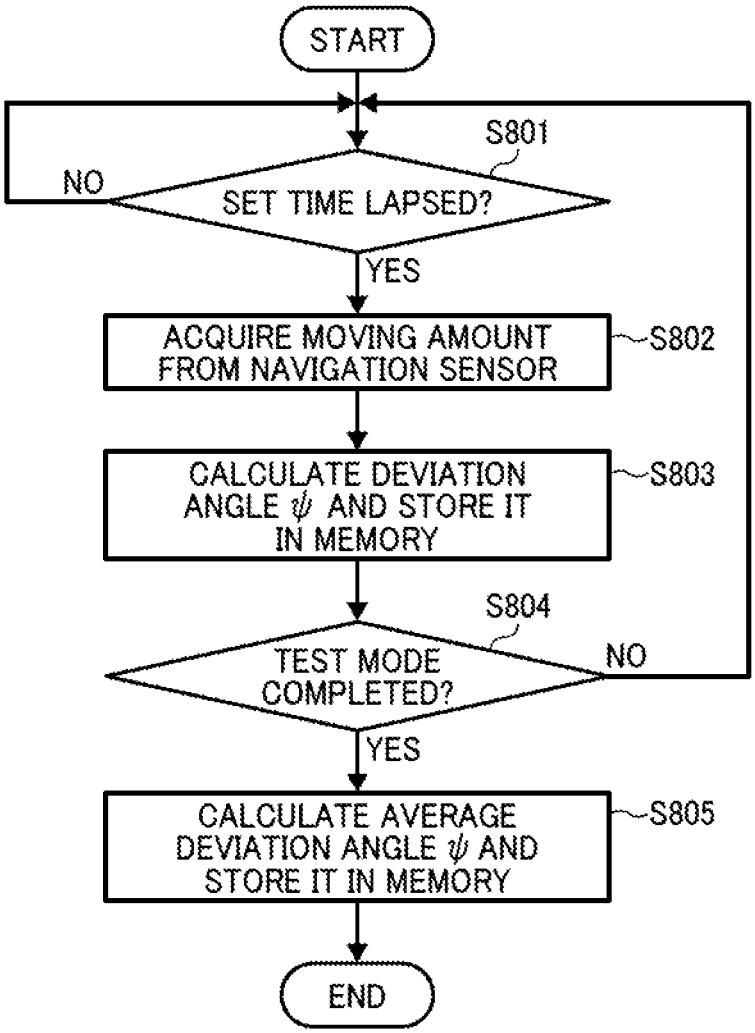
FIG. 8 is a flowchart illustrating the process of step S703 shown in FIG. 7 in accordance with an embodiment of the present invention.
Figure 10:
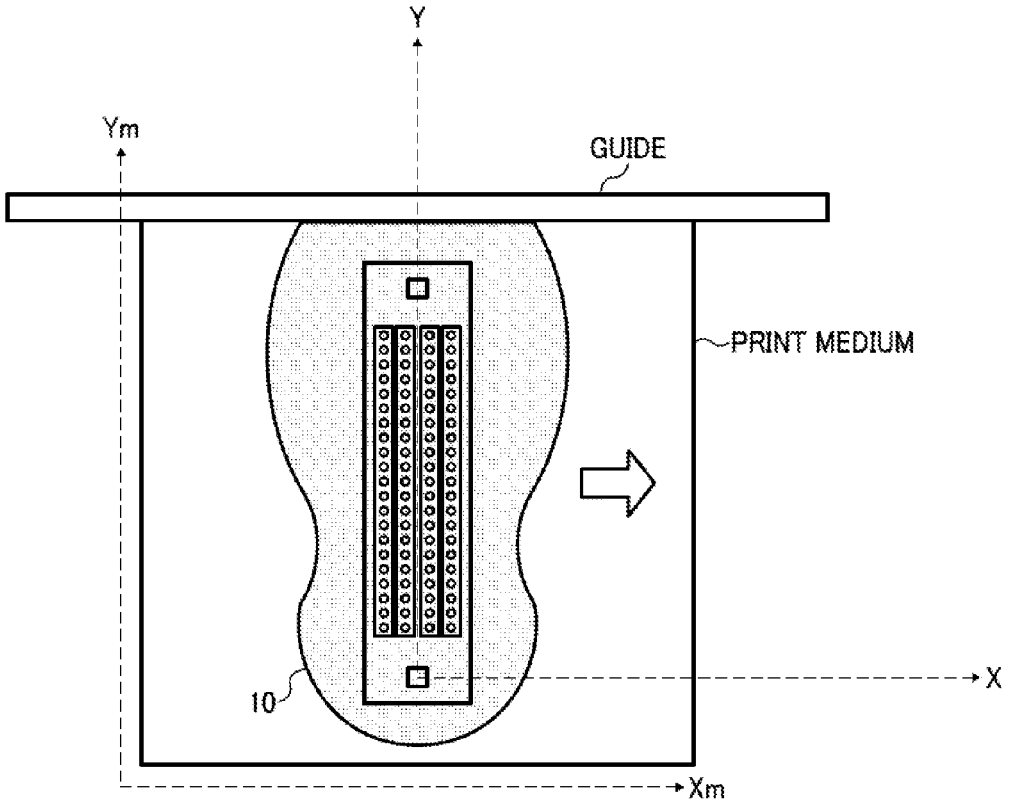
FIG. 10 is a schematic view of the hand-held printer and a guide used in a test mode in accordance with an embodiment of the present invention.

FIG. 8 is a flowchart illustrating the process of step S703 shown in FIG. 7 in accordance with an embodiment of the present invention. During the test mode operation, user performs a calibration movement that is a parallel transition of the hand-held printer 10. In particular, user translates the hand-held printer 10 along a guide arranged in parallel with the X-axis direction defined by the recording head of the hand-held printer 10, as illustrated in FIG. 10. The process of calculating the deviation angle of the navigation sensor 24 by the angle calculator 42 during the test mode operation is described below with reference to FIG. 8.

As the processing shown in FIG. 8 starts, in step S801, the time determination unit 420 of the angle calculator 42 determines whether a set time (lead time) has lapsed or not using the timing generation circuit 312. Preferably, the set time is a minute time needed for calculating a significant moving amount of the hand-held printer 10 that has been moved by user.

When the set time has not lapsed (NO), the process of step S801 is repeated. When the set time has lapsed (YES), the processing proceeds to step S802.

In step S802, the deviation angle calculator 421 acquires a calibration moving amount (ΔX',ΔY') from the navigation sensor 24. In step S803, the deviation angle calculator 421 calculates a deviation angle of the navigation sensor 24 by plugging the calibration moving amount acquired from the navigation sensor 24 into the following formula 1, and stores it in a memory.

$$\psi = \tan^{-1}\left(\frac{\Delta Y'}{\Delta X'}\right) \qquad \text{Formula 1}$$

In the formula 1, ψ represents a deviation angle of the navigation sensor 24, and ΔX' and ΔY' respectively represent X'-axis and Y'-axis components of a calibration movement vector of the navigation sensor 24 on the X'-Y' plane, as illustrated in FIG. 11.

In step S804, the completion determination unit 422 determines whether the test mode has been completed or not. When it is determined that the test mode has not been completed (NO), the processing returns to step S801 and the processes through S801 to S804 are repeated. When it is determined that the test mode has been completed (YES), the processing proceeds to step S805.

In step S805, the deviation angle calculator 421 acquires all the angle values stored in the memory in step S803, calculates an average of these angle values, and stores the average as a deviation angle ψ of the navigation sensor 24 in the memory, and then the processing is completed.

Figure 9:
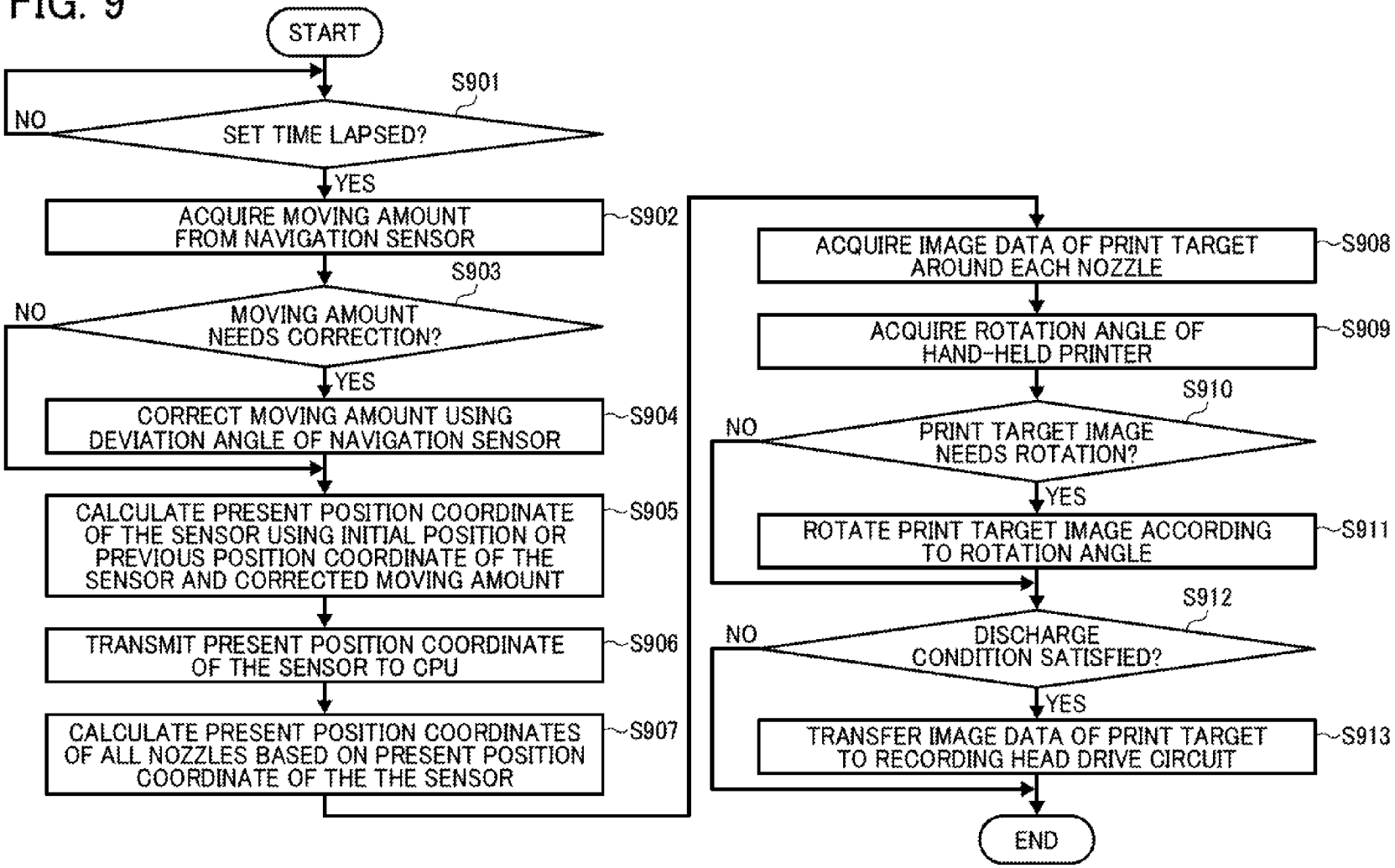
FIG. 9 is a flowchart illustrating the process of step S710 shown in FIG. 7 in accordance with an embodiment of the present invention.

FIG. 9 is a flowchart illustrating the process of step S710 shown in FIG. 7 in accordance with an embodiment of the present invention. As the processing shown in FIG. 9 starts, in step S901, the time determination unit 470 of the moving amount corrector 47 determines whether a set time has lapsed or not using the timing generation circuit 312. Preferably, the set time satisfies a head drive period (e.g., a drive period defined by the length of drive waveform for driving a piezo head) and/or an image transfer time.

When the set time has not lapsed (NO), the process of step S901 is repeated. When the set time has lapsed (YES), the processing proceeds to step S902.

In step S902, the moving amount acquisition unit 471 acquires a moving amount (ΔX',ΔY') from the navigation sensor 24. In step S903, the correction necessity determination unit 472 determines whether the moving amount (ΔX', ΔY') needs correction or not using the deviation angle ψ stored in the memory. When the moving amount does not need correction (NO), the processing proceeds to step S905. When the moving amount needs correction (YES), the processing proceeds to step S904.

In step S904, the moving amount correction unit 473 corrects the moving amount (ΔX',ΔY') using the deviation angle ψ. More specifically, the moving amount correction unit 473 calculates a corrected moving amount (ΔX, ΔY) by plugging the moving amount (ΔX',ΔY') and the deviation angle ψ into the following formula 2.

$$\Delta X = \Delta X' \times \cos\psi + \Delta Y' \times \sin\psi$$

$$\Delta Y = \Delta X' \times \sin\psi + \Delta Y' \times \cos\psi \qquad \text{Formula 2}$$

In step S905, the position calculation circuit 303 calculates the present position coordinate of the navigation sensor 24 using the initial position set in step S709 or the previous position coordinate of the navigation sensor 24 and the corrected moving amount (ΔX, ΔY), and store it in a memory. When it is determined that the moving amount does not need correction, the present position coordinate of the navigation sensor 24 is calculated using the moving amount (ΔX', ΔY').

In a case where the processing shown in FIG. 9 is executed for the first time after the initial position has been set in step S709, the position calculation circuit 303 calculates the present position coordinate of the navigation sensor 24 using the initial position and the corrected moving amount (ΔX, ΔY).

On the other hand, in a case where the processing shown in FIG. 9 is repeatedly executed, the position calculation circuit 303 calculates the present position coordinate of the navigation sensor 24 using the previous position coordinate of the navigation sensor 24 and the corrected moving amount (ΔX, ΔY). The method of calculating the position coordinate of the navigation sensor 24 is described later with reference to FIG. 14.

In step S906, the position calculation circuit 303 transmits the present position coordinate of the navigation sensor 24 to the CPU 301. In step S907, the nozzle position calculator 48 of the CPU 301 calculates the present position coordinates of all the nozzles included in the recording head based on the present position coordinate of the navigation sensor 24. The method of calculating the position coordinates of the nozzles is described later with reference to FIGS. 15 to 18.

In step S908, the DMAC 315 acquires image data of a print target around each nozzle based on the present position coordinates of the nozzles calculated by the nozzle position calculator 48. In step S909, the rotator 316 acquires a rotation angle of the hand-held printer 10 calculated by the position calculation circuit 303. In step S910, the rotator 316 determines whether the image data of the print target needs rotation or not based on the rotation angle. When the rotation angle is zero, the rotator 316 determines that the image data of the print target does not need rotation. When the rotation angle is not zero, the rotator 316 determines that the image data of the print target needs rotation.

When it is determined that the image data of the print target does not need rotation (NO), the processing proceeds to step S912. When it is determined that the image data of the print target needs rotation (YES), the processing proceeds to step S911. In step S911, the rotator 316 rotates the image data of the print target in accordance with the rotation angle.

Figure 19:
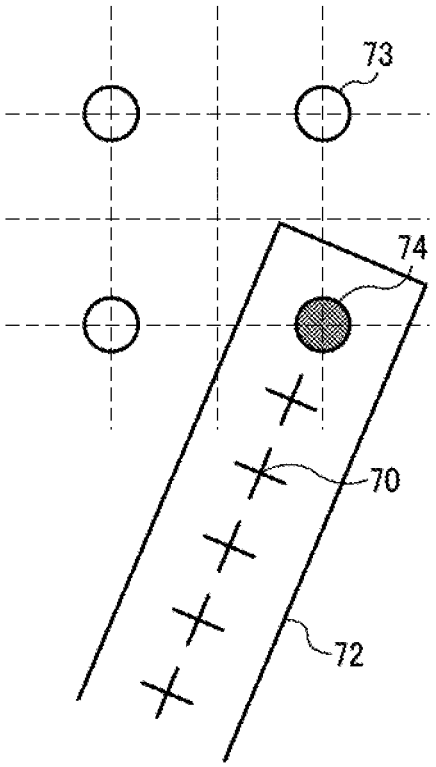
FIG. 19 is an illustration showing a method of determining discharge condition.

In step S912, the rotator 316 determines whether the discharge condition is satisfied or not using the image data of the print target and the position of each nozzles on the recording head. More specifically, the rotator 316 determines that the discharge condition is satisfied when a position coordinate of each nozzle is coincident with a position coordinate of the image data of the print target on a print medium plane Xm-Ym. For example, as shown in FIG. 19, when a position coordinate 74 of image data represented by a black circle is coincident with a position coordinate of a foremost nozzle 70 of the recording head, the rotator 316 determines that the discharge condition is satisfied. By contrast, when the position coordinate of image data is not coincident with any position coordinate of each nozzle, the rotator 316 determines that the discharge condition is not satisfied.

When the discharge condition is not satisfied (NO), the processing is completed. When the discharge condition is satisfied (YES), the processing proceeds to step S913. In step S913, the DMAC 315 transfers the image data of the print target to the recording head control circuit 313, and then the processing is completed. The recording head control circuit 313 then transmits the image data of the print target to the recording head drive circuit 28, and each of the nozzles on the recording head discharges liquid droplets to the specified position coordinate on the print medium (i.e., the position coordinate of the nozzle as well as the image data of the print target on the print medium plane Xm-Ym) in accordance with the image data of the print target to be discharged thereto.

Figure 12:
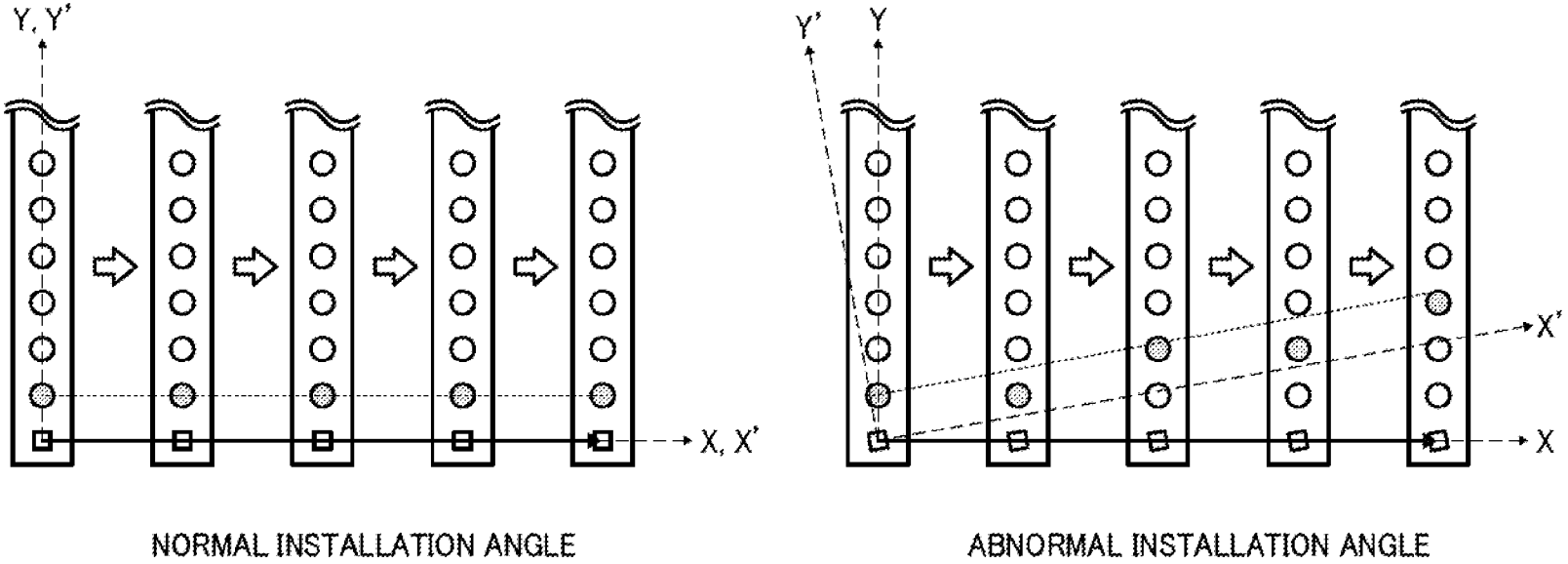
FIG. 12 is an illustration showing a method of detecting abnormality in installation angle of the navigation sensor in accordance with an embodiment of the present invention.

FIG. 12 is an illustration showing a method of detecting abnormality in installation angle of the navigation sensor 24 in accordance with an embodiment of the present invention. User translates the hand-held printer 10 along the guide in the X-axis direction as illustrated in FIG. 10 while printing a test pattern image for detecting abnormality in installation angle of the navigation sensor 24 on a print medium. In the present embodiment, a straight line in parallel with the X-axis is employed as the test pattern image.

Referring to FIG. 12, when the installation angle of the navigation sensor 24 is normal, a straight light in parallel with the X-axis, represented by black dots, is formed on the print medium. By contrast, when the installation angle of the navigation sensor 24 is abnormal, an image not in parallel with the X-axis is formed on the print medium. Thus, user can easily detect abnormality in installation angle of the navigation sensor 24.

Figure 13:
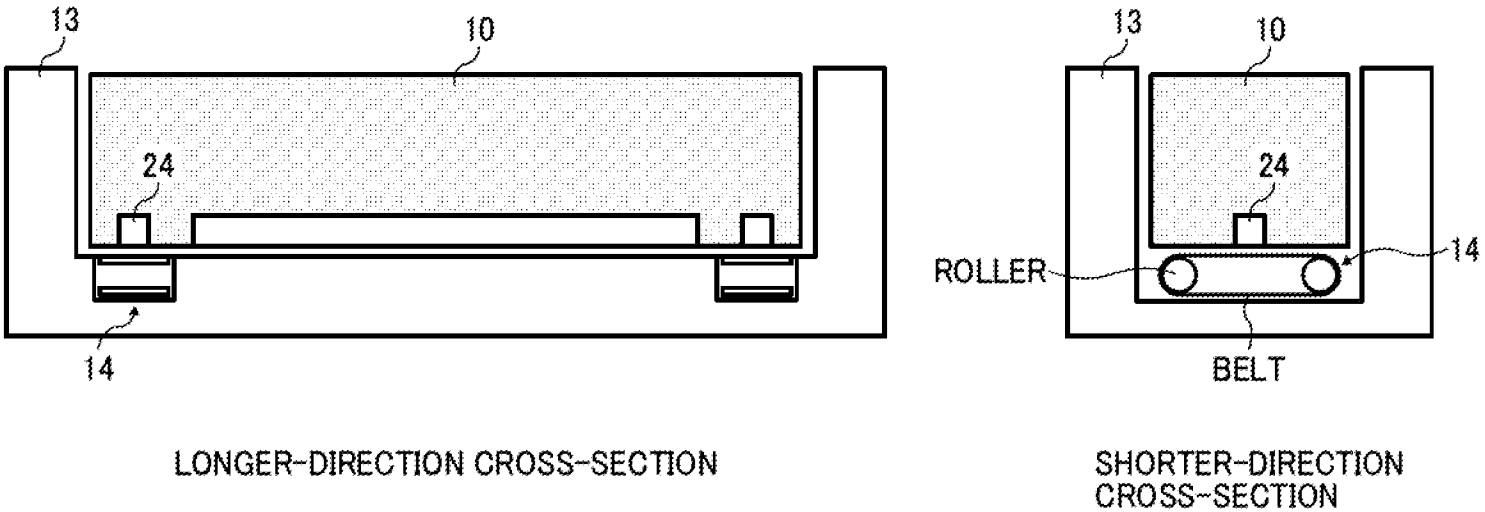
FIG. 13 is an illustration showing another method of detecting abnormality in installation angle of the navigation sensor in accordance with an embodiment of the present invention.

FIG. 13 is an illustration showing another method of detecting abnormality in installation angle of the navigation sensor 24 in accordance with an embodiment of the present invention. The method of detecting abnormality in installation angle of the navigation sensor 24 using a maintenance device is described below with reference to FIG. 13.

The hand-held printer 10 is stored in a maintenance device 13 when not in use as illustrated in FIG. 13. The maintenance device 13 has as installation angle abnormality detector 14 at a position facing the navigation sensor 24. The installation angle abnormality detector 14 includes a belt having an irregular surface and a roller for driving the belt. As the roller rotates, the belt rotates in the direction parallel to the shorter direction of the hand-held printer 10.

As the hand-held printer 10 is stored in the maintenance device 13, user depresses the test mode switch of the hand-held printer 10 to cause the belt of the maintenance device 13 to rotate. The hand-held printer 10 emits light to the belt (i.e., an object to be irradiated) and photographs the reflected light to generate image data, calculates a calibration moving amount of the belt based on a difference in the image data generated before and after a calibration movement of the belt, and calculates a deviation angle of the navigation sensor 24 using the calibration moving amount.

Figure 14:
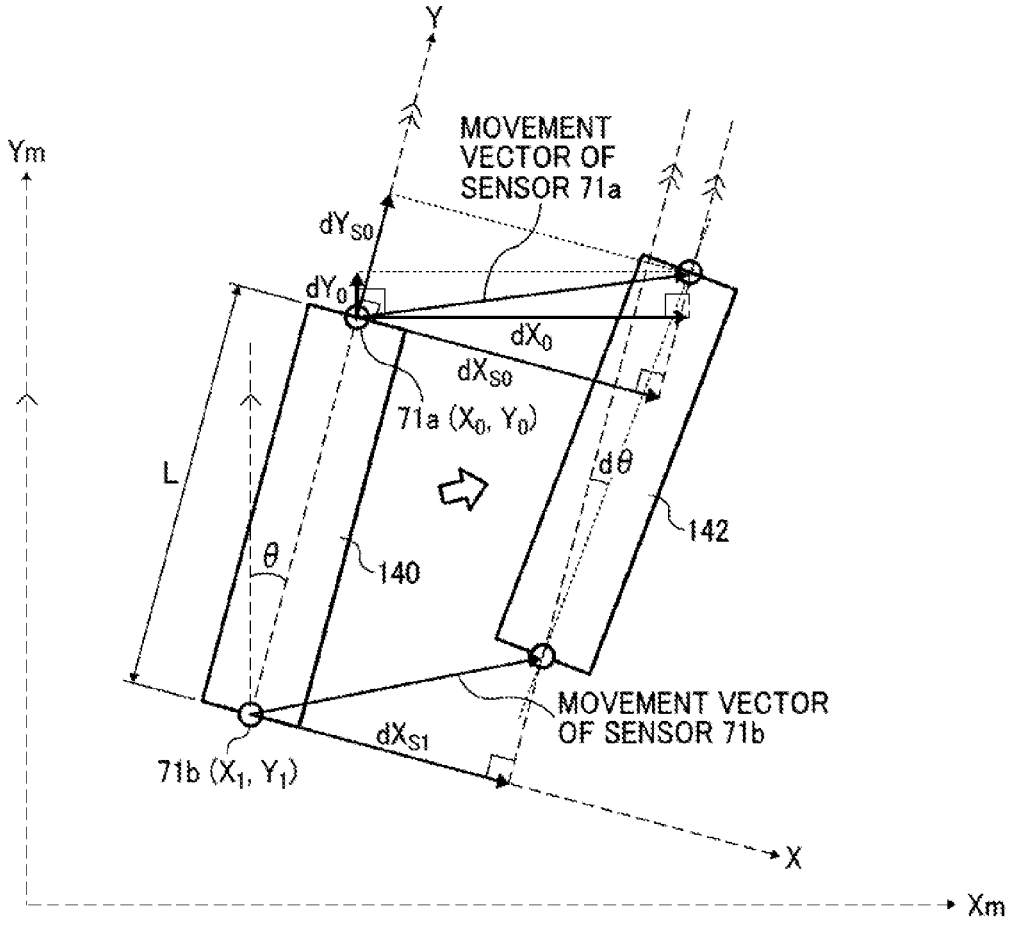
FIG. 14 is an illustration showing a method of calculating position coordinates of navigation sensors.

FIG. 14 is an illustration showing a method of calculating position coordinates of navigation sensors, where the navigations sensor 24 of the hand-held printer 10 includes two navigation sensors 71*a* and 71*b*. FIG. 14 shows a situation where user has moved the hand-held printer 10 that had been rotated by an angle θ relative to the Ym-axis of the Xm-Ym plane defined by horizontal and vertical directions of a print medium to perform printing, and as a result of the printing, the hand-held printer 10 has been further rotated by an angle dθ. The method of calculating position coordinates of the sensors 71*a* and 71*b* is described below with reference to FIG. 14.

In the present embodiment, rotary movement component and parallel movement component of the hand-held printer 10 are calculated. Post-printing position coordinates of the navigation sensors 71*a* and 71*b* are calculated from pre-printing position coordinates thereof and the rotary and parallel movement components of the hand-held printer 10.

The position calculation circuit 303 calculates a rotation angle dθ (i.e., rotary movement component) of the hand-held printer 10 before and after printing by plugging moving amounts of the navigation sensors 71*a* and 71*b* in the X-axis direction on the X-Y plane in the following formula 3. Hereinafter, the hand-held printer 10 at the position before printing is referred to as hand-held printer 140, and the hand-held printer 10 at the position after printing is referred to as hand-held printer 142, for the sake of convenience.

$$d\theta = \tan^{-1}\left(\frac{(dX_{S0} - dX_{S1})}{L}\right) \quad \text{Formula 3}$$

As illustrated in FIG. 14, dθ represents a rotation angle of the hand-held printer 10 before and after printing with respect to the Y-axis of the X-Y plane, i.e., an angle between the hand-held printer 140 at the position before printing and the hand-held printer 142 at the position after printing. $dX_{S0}$ is an X-axis component of a movement vector of the navigation sensor 71*a* on the X-Y plane representing a moving amount in the X-axis direction. $dX_{S1}$ is an X-axis component of a movement vector of the navigation sensor 71*b* on the X-Y plane representing a moving amount in the X-axis direction. L represents a distance between the navigation sensors 71*a* and 71*b*.

The position calculation circuit 303 calculates moving amounts of the navigation sensor 71*a* in the Xm-axis and Ym-axis directions on the Xm-Ym plane as parallel movement components by plugging moving amounts of the navigation sensor 71*a* in the X-axis and Y-axis directions on the X-Y plane in the following formula 4.

$$dX_0 = dX_{S0} \times \cos\theta + dY_{S0} \times \sin\theta$$

$$dY_0 = -dX_{S0} \times \sin\theta + dY_{S0} \times \cos\theta \quad \text{Formula 4}$$

In FIG. 14, position coordinates $(X_0, Y_0)$ and $(X_1, Y_1)$ represent initial position coordinates of the respective navigation sensors 71*a* and 71*b* before printing. $dX_0$ is an Xm-axis component of the movement vector of the navigation sensor 71*a* on the Xm-Ym plane representing a moving amount in the Xm-axis direction. $dY_0$ is an Ym-axis component of the movement vector of the navigation sensor 71*a* on the Xm-Ym plane representing a moving amount in the Ym-axis direction. θ represents an inclination angle of the hand-held printer 140 at a print-starting position with respect to the Ym-axis of the Xm-Ym plane. $dY_{S0}$ represents an Y-axis component of the movement vector of the navigation sensor 71*a* on the X-Y plane representing a moving amount in the y-axis direction. In the present embodiment, the inclination angle θ may be set by user at the time of print starting. In other embodiments, the inclination angle θ may be zero.

The position calculation circuit 303 calculates a post-printing position coordinate $(X_0+dX_0, Y_0+dY_0)$ of the navigation sensor 71*a* on the Xm-Ym plane using the initial position $(X_0, Y_0)$ of the navigation sensor 71*a* and $dX_0$ and $dY_0$ calculated from the formula 4.

The position calculation circuit 303 then identifies the post-printing position coordinate $(X_0+dX_0, Y_0+dY_0)$ of the navigation sensor 71*a* as a new initial position $(X_0, Y_0)$, and calculates a post-printing position coordinate $(X_1, Y_1)$ of the navigation sensor 71*b* on the Xm-Ym plane by plugging in the following formula 5 the post-printing position coordinate of the navigation sensor 71*a*, the inclination angle θ of the hand-held printer 140, the distance L, and the rotation angle dθ calculated from the formula 3. In the formula 5, the post-printing position coordinate of the navigation sensor 71*b* is calculated as a new initial position.

$$X_1 = X_0 - L \times \sin(\theta + d\theta)$$

$$Y_1 = Y_0 - L \times \cos(\theta + d\theta) \quad \text{Formula 5}$$

The post-printing position coordinates of the navigation sensors 71*a* and 71*b* are hereinafter calculated in the same manner.

Figure 15:
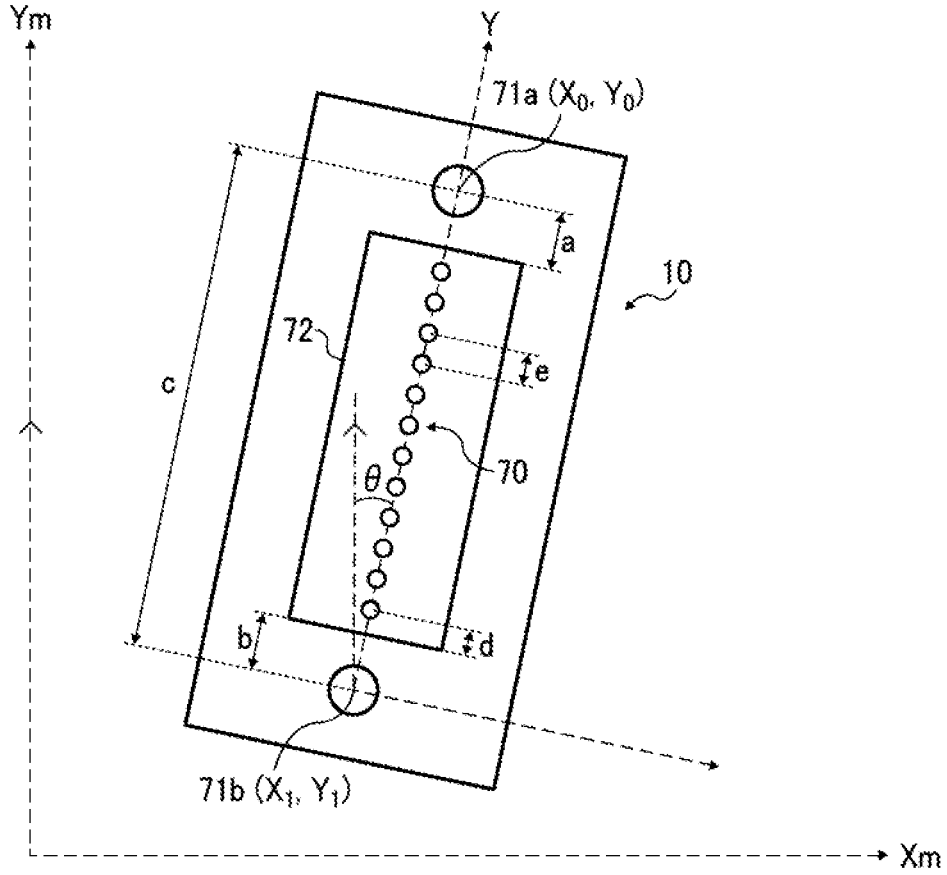
FIG. 15 is an illustration showing a method of calculating position coordinates of nozzles.

FIG. 15 is a schematic view of the recording head unit and navigation sensors of the hand-held printer 10 in accordance with an embodiment of the present invention. A method of calculating position coordinates of nozzles 70 on a line extended from the installation positions of the navigation sensors 71*a* and 71*b* is described below with reference to FIG. 15.

The navigation sensors 71*a* and 71*b* are installed to the hand-held printer 10. In particular, the navigation sensors 71*a* and 71*b* are installed in a longitudinal direction of multiple nozzles 70 arranged at regular intervals as illustrated in FIG. 15.

A symbol a represents a distance between the center of the navigation sensor 71*a* and an upper end of a recording head 72. A symbol b represents a distance between the center of the navigation sensor 71*b* and a lower end of the recording head 72. A symbol c represents a distance between the navigation sensors 71*a* and 71*b*. A symbol d represents a distance between one end of the recording head 72 and the nozzle 70 closest to the end. A symbol e represents a distance between two of the nozzles 70 adjacent to each other. The distances a to e are each predetermined. θ represents an inclination angle of the hand-held printer 140 at the position before printing with respect to the Ym-axis of the Xm-Ym plane.

The nozzle position calculator calculates a position coordinate $(NZL_N_X, NZL_N_Y)$ of each of the nozzles 70 by pugging the position coordinate (X0, Y0) of the navigation sensor 71*a* in the following formula 6.

$$NZL_N_X = X_0 - (a + d + (N-1) \times e) \times \sin\theta$$

$$NZL_N_Y = Y_0 - (a + d + (N-1) \times e) \times \cos\theta \quad \text{Formula 6}$$

Here, N represents an identification number of each of the nozzles 70 assigned from the navigation sensor 71*a* side in ascending order.

Figure 16:
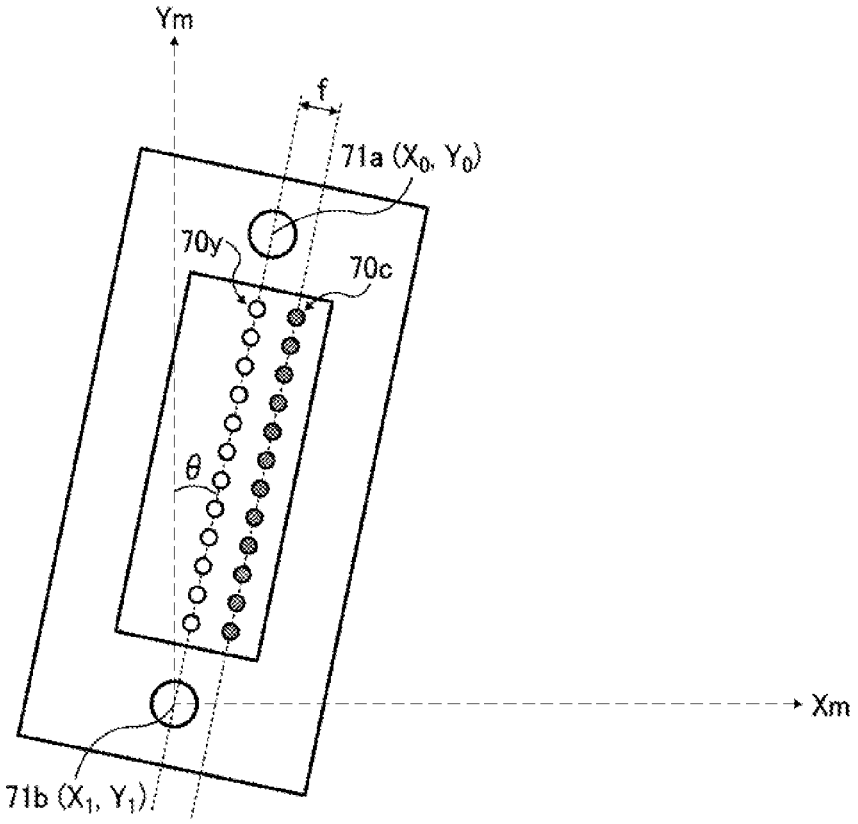
FIG. 16 is an illustration showing another method of calculating position coordinates of nozzles.

FIG. 16 a schematic view of the recording head unit and navigation sensors of the hand-held printer 10 in accordance with another embodiment of the present invention. A method of calculating position coordinates of nozzles not on a line extended from the installation positions of the navigation sensors is described below with reference to FIG. 16.

In FIG. 16, a symbol f represents a distance between a row of nozzles 70*y* (which may discharge yellow liquid droplets) and another row of nozzles 70*c* (which may discharge cyan liquid droplets) each extending in a longitudinal direction. The nozzle position calculator calculates a position coordinate $(NZL_{C\text{-}N}_X, NZL_{C\text{-}N}_Y)$ of each of the nozzles 70*c* that is not on a line extended from the installation positions of the navigation sensors 71*a* and 71*b* by pugging the distance f between the nozzle rows in the following formula 7.

$$NZ:_{C\text{-}N}_X = X_0 - (a + d + (N-1) \times e) \times \sin\theta + f \times \cos\theta$$

$$NZL_{C\text{-}N}_Y = Y_0 - (a + d + (N-1) \times e) \times \cos\theta - f \times \sin \quad \text{Formula 7}$$

The symbols a to e and θ are the same as those described above.

In the present embodiment, the position coordinate of each of the nozzles 70 is calculated using the formulae 6 and 7 employing trigonometric function. In other embodiments, the position coordinate of each of the nozzles 70 may be calculated using position coordinates of the foremost and rearmost nozzles.

Figure 17:
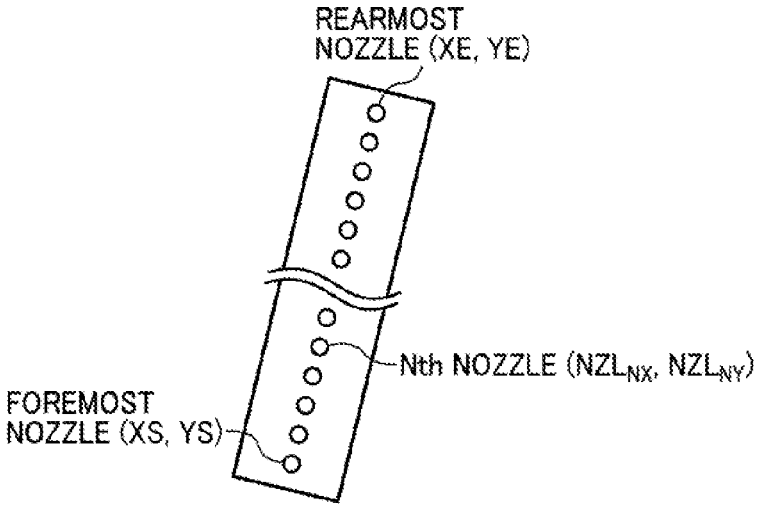
FIG. 17 is an illustration showing another method of calculating position coordinates of nozzles.
Figure 18:
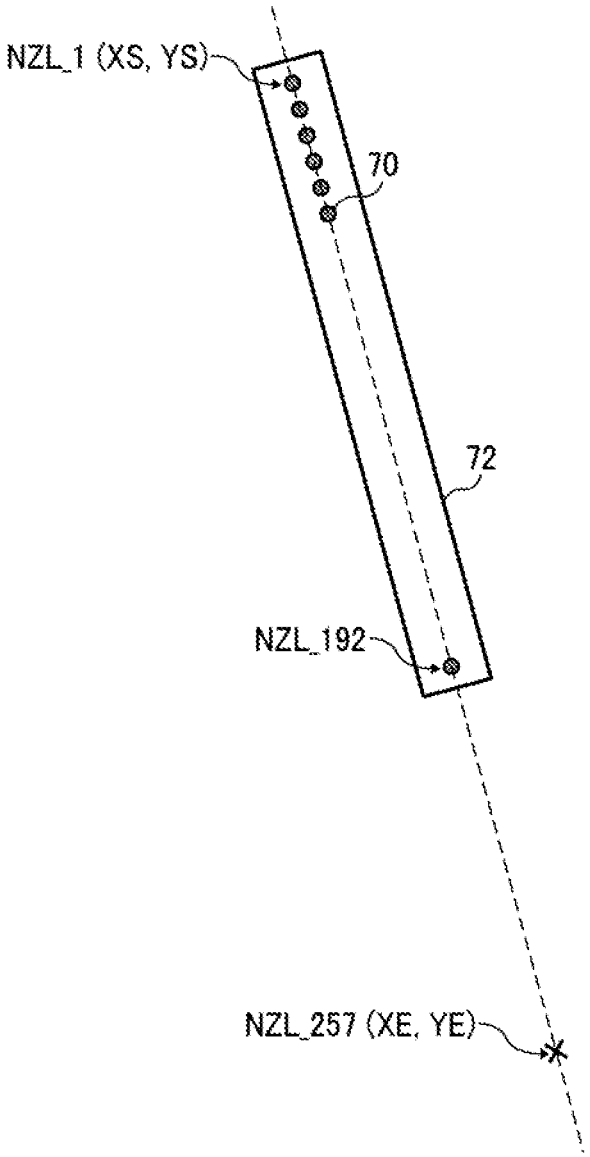
FIG. 18 is an illustration showing another method of calculating position coordinates of nozzles.

FIG. 17 is an illustration showing a method of calculating a position coordinate of each of the nozzles 70 using position coordinates of the foremost and rearmost nozzles. The method of calculating a position coordinate of each of the nozzles 70 using position coordinates of the foremost and rearmost nozzles is described below with reference to FIG. 17.

A position coordinate ($NZL_{NX}$, $NZL_{NY}$) shown in FIG. 17 represents a position coordinate of the Nth nozzle. N represents an identification number of each nozzle assigned from the foremost nozzle to the rearmost nozzle in ascending order. Position coordinates (XS, YS) and (XE, YE) represent position coordinates of the foremost and rearmost nozzles, respectively. E represents the number of nozzles included in a single nozzle row.

The nozzle position calculator calculates a position coordinate ($NZL_{NX}$, $NZL_{NY}$) of the Nth nozzle by pugging in the following formula 8 the position coordinates (XS, YS) and (XE, YE) of the foremost and rearmost nozzles, respectively, N, and E.

$$NZL_{NX} = XS + \frac{XE - XS}{E - 1} \times N \qquad \text{Formula 8}$$

$$NZL_{NY} = YS + \frac{YE - YS}{E - 1} \times N$$

In other embodiments, a position coordinate of each nozzle may be calculated using a virtual point on a line extended from a nozzle row. More specifically, the nozzle position calculator may calculate a position coordinate ($NZL_{NX}$, $NZL_{NY}$) of the Nth nozzle by pugging in the following formula 9 the position coordinates (XS, YS) and (XE, YE) of the foremost nozzle (NZL_1) and the virtual point, respectively, and N.

$$NZL_{NX} = \frac{XS \times (257 - N) + XE \times (N - 1))}{256} \qquad \text{Formula 9}$$

$$NZL_{NY} = \frac{YS \times (257 - N) + YE \times (N - 1)}{256}$$

N represents an identification number of each nozzle assigned from the foremost nozzle to the rearmost nozzle in ascending order. The position coordinate (XE, YE) of the virtual point can be calculated from the position coordinate of the foremost or rearmost nozzle and the regular interval e between the nozzles. It is to be noted that the formula 9 assumes that the virtual point is coincident with the position coordinate of the 257th nozzle. The constant numbers in the formula 9 vary depending on the position of the virtual point.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. A printer performing printing while being moved on a print medium, comprising:

an optical moving amount calculator that calculates a moving amount of the printer or an object to be irradiated after a movement thereof, based on a difference in image data generated before and after the movement, the image data generated by emitting light to the print medium or the object and receiving light reflected therefrom;

an angle calculator that calculates a deviation angle of an installation angle of the optical moving amount calculator installed in the printer, based on a calibration moving amount of the printer or the object after a calibration movement thereof that is a parallel translation; and a moving amount corrector that corrects the moving amount of the printer after the movement thereof, based on the calculated deviation angle of the optical moving amount calculator.

2. The printer according to claim 1, further comprising:

a plurality of dischargers that discharge liquid droplets in accordance with image data of a print target; and a position calculator that calculates a position coordinate of each of the dischargers on the print medium based on the corrected moving amount of the printer.

3. The printer according to claim 2, wherein, when the position coordinate of one of the discharger on the print medium coincides with a position coordinate of the image data of the print target, the discharger discharges liquid droplets to the coincided position coordinate in accordance with the image data of the print target.

4. A method of printing performed by a printer being moved on a print medium, comprising:

emitting light to the print medium or an object to be irradiated;

receiving light reflected from the print medium or the object to generate image data;

calculating a moving amount of the printer after a movement thereof, based on a difference in the image data generated before and after the movement;

calculating a deviation angle of an installation angle of the optical moving amount calculator installed in the printer, based on a calibration moving amount of the printer or the object after a calibration movement thereof that is a parallel translation; and correcting the moving amount of the printer after the movement thereof, based on the calculated deviation angle of the optical moving amount calculator.

5. The method according to claim 4, further comprising:

calculating a position coordinate of a discharger included in the printer on the print medium based on the corrected moving amount.

6. The method according to claim 5, further comprising:

when the position coordinate of the discharger on the print medium coincides with a position coordinate of image data of a print target, discharging liquid droplets to the coincided position coordinate in accordance with the image data of the print target.

7. A non-transitory recording medium storing a plurality of instructions which, when executed by one or more processors, cause the processors to perform a method, comprising:

emitting light to the print medium or an object to be irradiated;

receiving light reflected from the print medium or the object to generate image data;

calculating a moving amount of the printer after a movement thereof, based on a difference in the image data generated before and after the movement;

calculating a deviation angle of an installation angle of the optical moving amount calculator installed in the printer, based on a calibration moving amount of the printer or the object after a calibration movement thereof that is a parallel translation; and correcting the moving amount of the printer after the movement thereof, based on the calculated deviation angle of the optical moving amount calculator.

* * * * *